United States Patent [19]

Krohn

[11] Patent Number: 4,837,934

[45] Date of Patent: Jun. 13, 1989

[54] LIGHTWEIGHT CHAIN SAW BAR

[76] Inventor: Paul F. Krohn, Elsie Route Box 1335, Seaside, Oreg. 97138

[21] Appl. No.: 79,931

[22] Filed: Jul. 31, 1987

[51] Int. Cl.[4] ..... B27B 17/02
[52] U.S. Cl. ..... 30/387; 30/383
[58] Field of Search ..... 30/381–387

[56] References Cited

U.S. PATENT DOCUMENTS

| | | | |
|---|---|---|---|
| 3,191,646 | 6/1965 | Merz | 143/32 |
| 3,250,304 | 5/1966 | Merz | 143/32 |
| 3,301,283 | 1/1967 | Merz | 143/32 |
| 4,393,590 | 7/1983 | Pantzar | 30/387 |

FOREIGN PATENT DOCUMENTS

| | | | |
|---|---|---|---|
| 657445 | 2/1963 | Canada | 30/387 |
| 1136812 | 9/1962 | Fed. Rep. of Germany | 30/387 |
| 213969 | 6/1941 | Switzerland | 30/387 |
| 930538 | 6/1963 | United Kingdom | 30/387 |

*Primary Examiner*—Douglas D. Watts
*Attorney, Agent, or Firm*—James D. Givnan, Jr.

[57] ABSTRACT

A chain saw bar defines an elongate open area within which is formed an insert member of a lightweight, nonmetallic material. An internal edge structure of the saw bar includes an inwardly directed, apertured flange. The insert member is formed with portions overlying opposite sides of the flange and at least partially occupies openings therein to enhance securement to the bar. An insert member of a fiber reinforced material is disclosed.

3 Claims, 1 Drawing Sheet

LIGHTWEIGHT CHAIN SAW BAR

BACKGROUND OF THE INVENTION

The present invention concerns generally saw bars of the type coupled to a small engine which drives a continuous saw chain about the perimeter of an elongate saw bar.

Saw bar weight is very important particularly to those in the logging industry for the reason that the cahin saw must be carried over rough terrain and manipulated into position for and during a cutting operation over a period of several hours constituting a work shift. Accordingly, any weight savings effort is highly desirable as over a period of time such would constitute a substantial reduction in the effort required on the saw operator's part. Attempts have been made to lighten saw bar construction, however, apparently such efforts have not been well received in the industry as saw bar construction has apparently not changed, with regard to weight reduction, for many years.

U.S. Pat. No. 4,393,590 discloses a saw bar of composite construction having outer wall surfaces of reinforced plastic material with an inner core of honeycomb metal. The saw tooth guiding channel is defined by solid metal components. Such saw bar construction would result in a bar of greater thickness than conventional saw bars and hence require a wider kerf for blade passage through the work piece. Additionally, such composite construction is believed to be quite costly requiring several steps during bar fabrication.

U.S. Pat. No. 3,191,646 discloses a chain saw bar of laminated construction wherein the outer laminates are steel and the inner laminate being of some lighter metal such as aluminum, magnesium or a plastic. Elongate inserts of wear resistant metal are required to isolate each tooth from the softer inner laminate. The bar is assembled by means of pins. Such blade construction is obviously very costly and of doubtful durability in view of the severe treatment saw bars are subjected to.

U.S. Pat. Nos. 3,301,282 and 3,250,304 both show saw bars of composite construction having insertable wear strips on which the teeth ride with one of the saw bars being of laminated construction.

None of the above-mentioned saw bar structures are known to be commercially available to the public.

SUMMARY OF THE PRESENT INVENTION

The present lightweight chain saw bar utilizes a stiffener member of lightweight synthetic material integral with the remaining structure of the saw bar to effect a weight reduction without loss of important features of saw bars currently in use.

An open area is formed in the present saw bar which extends lengthwise thereof with the area defining edge of the saw bar being shaped to retain an insert of lightweight, nonmetallic material. Such saw bar construction permits a weight savings to be accomplished without adversely altering such features of the saw bar such as its thickness and durability as well as conventional saw bar attachment means. Additionally, the use of a nonmetallic insert does not adversely affect blade flaxibility or longevity. An internal edge structure of the saw bar is of irregular shape for purposes of insert securement to the bar without reliance on fasteners. Openings in the edge structure permit passage of the nonmetallic insert material therethrough to enhance insert attachment.

Important objectives include the provision of a lightweight saw bar which retains all of the desirable features of saw bars developed over many years of testing and use yet providing a saw bar of reduced weight; the provision of a lightweight saw bar which may utilize existing saw bar structure as a component in the new saw bar; the provision of a lightweight saw bar shaped with an inner edge configuration suitable for the reception of a variety of lightweight materials which, in effect, when in place are integral with the metal portion of the saw bar; the provision of a lightweight saw bar that lends itself to more precise and safe placement on the work piece to prevent saw kickback and injury.

DETAILED DESCRIPTION OF THE PREFERRED EMBODIMENTS

Figure 1:
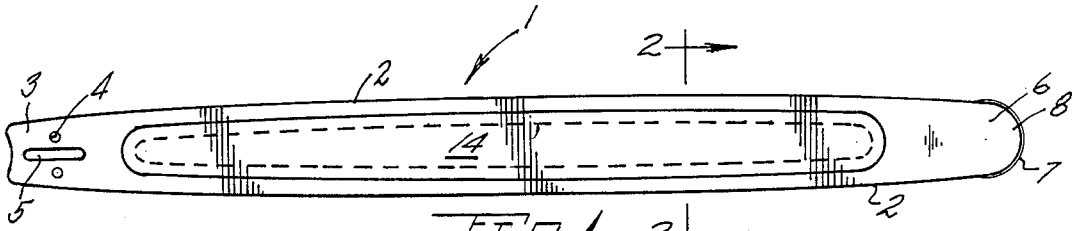
FIG. 1 is a side elevational view of a saw bar embodying the present invention.

With continuing attention to the drawing wherein applied reference numerals indicate parts similarly hereinafter identified, the reference numeral 1 indicates generally a chain saw bar having a perimeter at 2 along which a continuous saw chain (not shown) travels.

An inner end 3 of the saw bar is provided with openings at 4 and 5 provided for the purpose of engagement with attachment means on the chain saw motor housing for removable attachment of the saw bar to the housing. Typically, in place on the outer end 6 of the saw bar is a sprocket 7 which facilitates reversal of saw chain travel about the nose 8 of the bar. The upper and lower extremities of the saw bar, as well as the saw bar nose, define a continuous channel or groove 10 along which travels a portion of the saw chain while additional portions of the saw chain ride on saw bar perimeter surfaces 11 and 12. The foregoing is intended to be typical of saw bar construction of high grade steel.

The present saw bar metal portion defines an open area 13 which is orientated lengthwise of said bar and terminates adjacent the bars inner and outer ends. An internal edge configuration defines open area 13 and facilitates securement of a saw bar insert member at 14. A flange at 15, of said edge configuration, projects inwardly from saw bar shoulders at 16 which flange terminates inwardly at an edge 17. The flange is medial of a saw bar medial plane P. Said flange defines, at intervals along its length, a series of openings 18 which contribute to both weight reduction of the bar as well as to insert member securement, as later explained.

Figure 2:
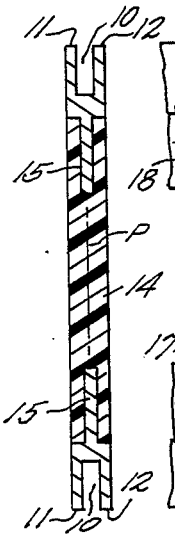
FIG. 2 is a vertical sectional view taken along line 2—2 of FIG. 1.
Figure 3:
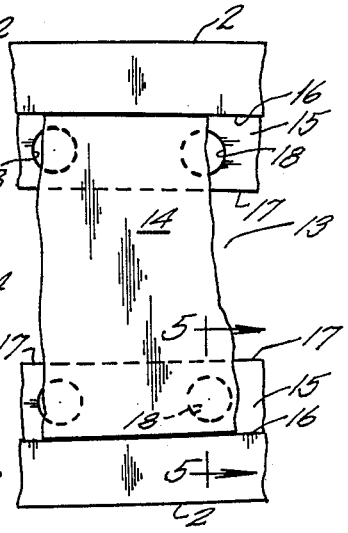
FIG. 3 is a fragmentary elevational view of the saw bar.
Figure 5:
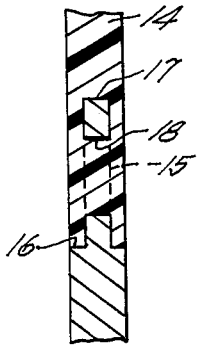
FIG. 5 is a vertical sectional view taken along line 5—5 of FIG. 3.

With attention to FIG. 2, it will be seen that the insert member 14 is of no greater width than the metal portion of the saw bar 1 to permit the saw kerf to be of standard width.

Figure 4:
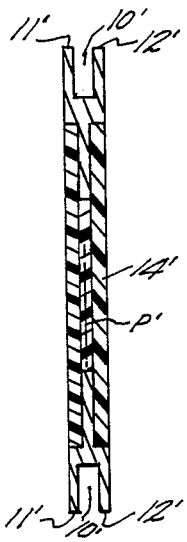
FIG. 4 is a view similar to FIG. 2 but showing a modified form of insert.

The insert member may be formed in place within the bar with fibrous reinforcing material, such as woven fiberglass sheets, applied between the bar inner edges 17 as well as intermediate bar shoulders 16. The application of a resin or other plastic material serves to join the fibrous sheets constituting a reinforcing component of the insert into a unitary member having outer edges abutting bar flange edge 17 and shoulders 16. The openings 18 are of a size to be at least partially filled by the plastic material to contribute toward the securement of the insert member in place. Such fibrous material is arranged in plies of different areas so as to be received between the bar flange edge 17 and the saw bar shoulders 16. Adhesively joined plies of reinforcing material may be utilized as the insert member as for example a composite structure of carbon fiber material at 14' in FIG. 4. Such material is available impregnated with a thermosetting resin for laminating purposes.

The present saw bar is particularly suited for use by those in the logging industry where handling of a chain saw over a period of several hours each work shift renders chain saw weight critical as injuries to chain saw users are often attributable, at least partially, to fatigue.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

I claim:

1. A saw bar for a powered chain saw, said saw bar including, internal edge structure defining an open area, said edge structure including shoulders and a flange therebetween extending substantially about the open area, said flange having an inner edge, and an insert member of non-metallic material in place in said open area of the saw bar and in partial surfacial engagement with surfaces of the flange, said insert member being of a composite nature and formed during installation in said open area and including plies of fibrous sheet material, some of said plies in surfacial engagement with the surfaces of said flange.

2. The saw bar claimed in claim 1 wherein said some of said plies are adhesively joined to the surfaces of the flange.

3. The saw bar claimed in claim 1 wherein said flange defines a series of openings.

* * * * *